US008007260B2

(12) United States Patent
Yanagisawa

(10) Patent No.: US 8,007,260 B2
(45) **Date of Patent: *Aug. 30, 2011**

(54) SCROLL FLUID MACHINE HAVING A COUPLING MECHANISM TO ALLOW RELATIVE ORBITING MOVEMENT OF SCROLLS

(75) Inventor: Ken Yanagisawa, Yokohama (JP)

(73) Assignee: Anest Iwata Corporation (JP)

( * ) Notice: Subject to any disclaimer, the term of this patent is extended or adjusted under 35 U.S.C. 154(b) by 633 days.

This patent is subject to a terminal disclaimer.

(21) Appl. No.: 12/058,858

(22) Filed: Mar. 31, 2008

(65) Prior Publication Data

US 2008/0240957 A1 Oct. 2, 2008

(30) Foreign Application Priority Data

Mar. 30, 2007 (JP) ..... 2007-095580

(51) Int. Cl.
*F03C 4/00* (2006.01)
*F04C 18/00* (2006.01)

(52) U.S. Cl. ..... 418/55.3; 418/55.1; 418/60; 418/188; 464/102; 464/104

(58) Field of Classification Search ..... 418/55.1–55.6, 418/57, 60, 188; 464/102, 104
See application file for complete search history.

(56) References Cited

U.S. PATENT DOCUMENTS

| | | | | | |
|---|---|---|---|---|---|
| 5,149,255 | A | * | 9/1992 | Young | 418/55.3 |
| 5,320,506 | A | * | 6/1994 | Fogt | 418/55.3 |
| 5,403,172 | A | * | 4/1995 | Blass et al. | 418/55.3 |
| 6,030,193 | A | * | 2/2000 | Kimura | 418/55.3 |
| 6,113,371 | A | * | 9/2000 | Williams et al. | 418/55.3 |

FOREIGN PATENT DOCUMENTS

| | | | | |
|---|---|---|---|---|
| JP | 02091488 | A | * | 3/1990 |
| JP | 04132888 | A | * | 5/1992 |
| JP | 05223068 | A | * | 8/1993 |
| JP | 05248369 | A | * | 9/1993 |
| JP | 06081780 | A | * | 3/1994 |
| JP | 2756808 | B2 | | 3/1998 |
| JP | 2003-106268 | A | | 4/2003 |

OTHER PUBLICATIONS

Related co-pending U.S. Appl. No. 12/058,878; Ken Yanagisawa; "A Scroll Fluid Machine"; filed Mar. 31, 2008; Spec. pp. 1-34; Figs. 1-14b.

* cited by examiner

*Primary Examiner* — Theresa Trieu
(74) *Attorney, Agent, or Firm* — Rossi, Kimms & McDowell LLP

(57) ABSTRACT

A scroll fluid machine has a stationary scroll having a stationary scroll lap fixed to a scroll casing and an orbiting scroll having an orbiting scroll lap that orbits relative to the stationary scroll lap. The stationary and orbiting scrolls are connected via a coupling mechanism other than an Oldham coupling or pin crank type mechanism having sliding parts. The coupling mechanism includes plate springs that connect the stationary scroll to the orbiting scroll. The orbiting scroll lap engages with the stationary scroll lap to form a closed compression chamber.

6 Claims, 8 Drawing Sheets

SCROLL FLUID MACHINE HAVING A COUPLING MECHANISM TO ALLOW RELATIVE ORBITING MOVEMENT OF SCROLLS

TECHNICAL FIELD

The present invention relates to a scroll fluid machine for compressing fluid, specifically relates to a mechanism for revolving the revolving scroll of the scroll fluid machine.

BACKGROUND ART

Rotation prevention mechanism for preventing rotation of the revolving scroll and defining the radius of revolution thereof such as a crank mechanism and Oldham coupling has been adopted in scroll fluid machines.

First, the principle of scroll compressor will be explained briefly with reference to FIGS. 8*a* to 8*d*.

A scroll compressor consists of a stationary scroll having a spiraling scroll lap 011 and a revolving scroll having a spiral lap 013. Gas ingested from an inlet port 017 is compressed as a revolving scroll revolves and the compressed gas is discharged from a discharge port 025 at the center. A stationary scroll lap 011 is formed on a disk fixed perpendicular to a rotation shaft. The revolving scroll lap 013 and the stationary scroll lap 011 spiral with phase difference of 180°. A crescent-shaped enclosed space (compression room) 015 formed between the inside surface 011*b* of the stationary scroll lap 011 and the outside surface 013*a* of the revolving scroll laps 013 is conveyed to the center of the scrolls reducing gradually in volume as the revolving scroll revolves (orbits).

In FIG. 8*a*, suction process ends when gas ingested from the suction port 017 is enclosed in the compression room formed between the outside surface 013*a* of the revolving scroll laps 013 and the inside surface 011*b* of the stationary scroll lap 011. Then, when a rotation shaft having an offset pin by which the revolving scroll is supported further rotates 90° as shown in FIG. 8*b*, the gas in the compression room 015 is conveyed toward the center of the scrolls and decreased in volume as compared with the compression room 015 in FIG. 8*a*.

When the rotation shaft further rotates 90° as shown in FIG. 8*c*, the gas in the compression room 015 is further conveyed toward the center and further decreased in volume.

In FIG. 8*d*, the compression room 015 is communicated with the discharge port 025 at the center and the compressed gas is discharger from the discharge port 025 as the rotation shaft further rotates.

As describer above, the revolving scroll must be orbited about the center of the rotation shaft without rotation. For allowing the revolving scroll to orbit without rotation, the revolving scroll is connected to the rotation shaft via an Oldham coupling or crank mechanism.

The principle of Oldham coupling will be briefly explained referring to FIG. 9. The Oldham coupling is a shaft coupling which can transmit torque between two parallel shafts offset from each other. In FIG. 9, a drive shaft 038 is supported for rotation about a rotation axis C1 and a driven shaft 039 is supported for rotation about a rotation axis C2 which is offset from the rotation axis C1 by E. The drive shaft 038 and driven shaft 039 have a drive flange 034 and driven flange 036 respectively. A disk 031 has a rectangular protrusion 032 and 033 formed on both sides thereof respectively, both the protrusions 032 and 033 extending perpendicular to each other passing through the center of rotation of the drive shaft 038. The drive flange 034 has a straight groove 035 and the driven flange 036 has a straight groove 037. The protrusion 032 of the disk 031 is received in the groove 035 of the drive flange 034 and protrusion 033 of the disk 031 is received in the groove 037 of the drive flange 034. When the drive shaft 038 is rotated, the driven shaft 039 is rotated in the same direction at the same rotation speed.

When the drive shaft is fixated not to be rotated and a member 040 supporting the driven shaft 039 is revolved about the rotation axis C1, the driven flange 036 revolves about the rotation axis C1 without itself being rotated, for its rotation is prevented by the engagement of the rectangular protrusions 032, 033 with the grooves 035, 036, the member 040 rotates relative to the drive shaft 039 instead.

In a case of scroll compressor, the drive flange 034 is a stationary scroll, the driven flange 036 is a revolving scroll, and the member 040 is a crank portion of a crankshaft for driving the compressor. Usually, said member 040 is formed to be a crank pin to be received via a bearing in a center hole of the revolving scroll, and said rectangular protrusions and grooves are formed on peripheral portions of the disk 031 (Oldham ring), drive flange 034 (stationary scroll), and driven flange 36 (revolving scroll) respectively.

For example, an Oldham coupling is adopted in scroll fluid machine disclosed in Japanese Patent No. 2756808 (patent literature 1). The scroll compressor is shown in longitudinal sectional view in FIG. 10*a*. A stationary scroll 051 having a spiraling lap 050 is fixed to a casing 052. A revolving scroll 054 having a spiral lap 053 is supported via a bearing 058 by a crank pin 056 of a crankshaft 057 supported for rotation by the casing 052. Oldham ring 059 is provided between the stationary scroll 051 and revolving scroll 054. When the crankshaft 057 is rotated, the revolving scroll 054 orbits around the rotation axis of the crankshaft without rotation.

The Oldham ring 059 has, as shown in FIG. 10*b*, rectangular protrusions 063 on one side thereof and rectangular protrusions 064 on the other side thereof. The protrusions 063, 064 are made by piling carbon fiber and cementing them by resin, to have improved anti-wear property.

In Japanese Laid-Open Patent Application No. 2003-106268 is disclosed a scroll fluid machine which adopts pin-crank type anti-rotation devices. As shown in FIGS. 11*a*, 11*b*, compression rooms 072 are formed between the spiral laps of the stationary scroll 070 and revolving scroll 071, and the revolving scroll 071 is supported by an offset pin portion of a crankshaft 073 via bearings 074.

Three pin crank type anti-rotation mechanism 079 are provided along a circle at equal circumferential spacing such that a journal of a pin crank 078 is supported by a casing, to which the stationary scroll 070 is fixed and the crank shaft 073 is supported for rotation, via two rolling bearings 077 and 077, and an offset pin portion of the pin crank 078 is supported by the end plate of the revolving scroll 071 via a rolling bearing 075.

In an Oldham coupling type anti-rotation mechanism, grooves and rectangular protrusions to be received in the grooves are formed as shown in FIG. 9, so abrasion of the grooves and rectangular protrusions tend to occur resulting in increased clearance therebetween, which produces vibration and noise. Therefore, according to the patent literature 1, the Oldham coupling type anti-rotation mechanism is composed to be improved in anti-wear property.

In a scroll fluid machine adopting pin crank type anti-rotation mechanism as shown in FIGS. 11*a*, 11*b*, usually three pin cranks are provided, and angular contact ball bearings are used to maintain proper clearance between the top faces of the scroll laps and the mating mirror surfaces of the stationary and revolving scrolls, structure becomes complicated resulting in increased manufacturing cost.

Further, the bearings of the pin cranks must be lubricated by lubrication oil or grease, controlling of temperature of the bearings is necessary, and there remains a problem that noise increases due to wear of the bearings.

In either case of adopting as anti-rotation mechanism the Oldham coupling mechanism or pin crank mechanism, it is necessary to supply lubrication oil and take measure against abrasion, so it is difficult to provide an oil-free scroll fluid machine. Even if the anti-rotation mechanism is composed of self-lubricating material, to completely solve the problem of increase in clearances is difficult as long as sliding parts exist in the mechanism.

Even if oil-free construction is realized in the compression rooms formed by the scroll laps, there remains fear that lubrication oil or grease for lubricating the anti-rotation mechanism intrudes into the compression rooms of the scroll compressor.

DISCLOSURE OF THE INVENTION

The present invention was made in light of the background mentioned above, and the object of the invention is to provide a scroll fluid machine provided with a mechanism for revolving the revolving scroll without rotation which does not include sliding parts and needs not be lubricated as does the conventional Oldham coupling type or pin crank type mechanism.

To attain the object, the invention proposes a scroll fluid machine comprising a first scroll having a first scroll lap and a second scroll having a second scroll lap, in which a plate spring member or members are provided to surround the scroll laps with a face of the plate spring member or members facing radially inwardly and connect the first and second scrolls, a rotation axial of the first scroll is not co-axial with the rotation axial of the second scroll, and relative revolving motion can be produced between the first and second scrolls.

According to the invention, the first scroll and the second scroll is connected by a plate spring member or members surrounding the scroll laps of both the scrolls with a face of the plate spring member or members facing radially inwardly so that relative movement between the first and second scrolls is possible in a plane perpendicular to the rotation axes of both scrolls, the center axes of both the scrolls are offset from each other so that relative revolving motion is produced between both the scrolls, so the relative revolving can be achieved without incorporating the Oldham coupling or pin crank mechanism which includes sliding parts. Therefore, a scroll fluid machine can be provided which requires no lubrication for anti-rotation mechanism making it maintenance-free, reduced in power for driving due to elimination of sliding parts, and decreased in noise due to absence of clearances of sliding parts.

The second scroll can be a stationary scroll fixed to a casing, and the first scroll is a revolving scroll which revolves about the center axis of the second scroll with a revolving radius of said offset.

The first scroll which is a revolving scroll can revolve about the center axis of the second scroll which is a stationary scroll without rotating itself while maintaining axial clearances between the tip faces of the scroll laps and mirror surfaces of both the stationary and revolving scrolls constant. By rotating a crankshaft having an offset crank pin on which the revolving scroll is supported rotatably, the revolving scroll revolves about the rotation axis of the crankshaft without rotating itself because the revolving scroll is prevented from rotating by the plate spring member or members connecting the revolving scroll to the stationary scroll, so fluid ingested and trapped in compression rooms formed between the scroll laps of both the scrolls is gradually compressed as the crankshaft rotates. Thus, a scroll fluid machine can be composed by using the simple anti-rotation mechanism.

According to the scroll fluid machine composed as mentioned above, rotation of the revolving scroll can be prevented by the anti-rotation mechanism which includes no sliding parts, and a scroll fluid machine can be provided which requires no lubrication for anti-rotation mechanism making it maintenance-free, reduced in power for driving due to elimination of sliding parts, and decreased in noise due to absence of clearances of sliding parts.

The first scroll can be a drive scroll connected to a drive shaft to be rotated, and the second scroll can be a driven scroll supported for rotation by a casing with the rotation axis of the driven scroll being offset from the rotation axis of the drive scroll, whereby rotation is transmitted from the drive scroll to the driven scroll and relative revolving motion is produced between the drive and driven scrolls.

The drive scroll and the driven scroll can be supported for rotation by a casing member with their rotation axes being offset from each other, when the drive scroll is rotated, the driven scroll connected to the drive scroll via the plate spring member or members is also rotated and relative revolving motion is produced between the drive and driven scrolls.

When the drive scroll is rotated by a drive motor, the driven scroll is via the plate spring member or members connecting the drive scroll to the driven scroll while maintaining axial clearances between the tip faces of the scroll laps and mirror surfaces of both the stationary and revolving scrolls constant, and relative revolving motion is produced between the drive and driven scrolls, so fluid ingested and trapped in compression rooms formed between the scroll laps of both the scrolls is gradually compressed as the drive scroll rotates. Thus, a scroll fluid machine can be composed by using the simple anti-rotation mechanism.

According to the scroll fluid machine composed as mentioned above, rotation of the revolving scroll relative to the driven scroll can be prevented by the anti-rotation mechanism which includes no sliding parts, and a scroll fluid machine can be provided which requires no lubrication for anti-rotation mechanism making it maintenance-free, reduced in power for driving due to elimination of sliding parts, and decreased in noise due to absence of clearances of sliding parts.

A plurality of first support flanges can be provided along a peripheral portion of said first scroll at equal circumferential spacing and a plurality of second support flanges are provided along a peripheral portion of said second scroll at equal circumferential spacing such that positions of the first and second support flanges are different in radial distance but coincident in radial direction respectively, and the first support flanges are connected to the second support flanges by plate spring member or members respectively. The support flanges each provided to each of the first and second scrolls to connect both the scrolls by fixing the plate spring member or members to the support flanges, are located along a peripheral portion of each of the first and second scrolls at equal circumferential spacing, so torque transmission from the first scroll to the second scroll via the plate spring member or members is evenly distributed between the support flanges and the revolving scroll can be revolved smoothly.

The first support flanges and second support flanges are connected with an annular plate spring.

As the first and second scrolls are connected with a single annular plate spring, structure is simplified and manufacturing cost is saved.

Four (No. 1 to No. 4) first support flanges can be provided along a peripheral part of the first scroll at equal circumferential spacing and four (No. 1 to No. 4) second support flanges can be provided along a peripheral part of the second scroll at equal circumferential spacing so that the first and second support flanges are positioned at different radial distances but coincident in radial direction respectively. The first and second support flanges adjacent to each other can be connected by four arcuate plate springs respectively so that one arcuate plate spring connects the No. 1 a first of the first support flanges to the No. 2 first support flange, another arcuate plate spring connects the No. 2 first support flange to the No. 3 second support flange, another arcuate plate spring connects the No. 3 first support flange to the No. 4 second support flange, another arcuate plate spring connects the No. 4 first support flange to the No. 1 second support flange. The four arcuate plate springs constituting a first row of arcuate plate springs connect the first support flanges to the second support flanges. Another row of four arcuate plate spring are provided adjacent in the axial direction to the first row of arcuate plate springs so that one arcuate plate spring connects the No. 1 second support flange to the No. 2 first support flange, another arcuate plate spring connects the No. 2 second support flange to the No. 3 first support flange, another arcuate plate spring connects the No. 3 second support flange to the No. 4 first support flange, another arcuate plate spring connects the No. 4 second support flange to the No. 1 first support flange.

Two groups of arcuate plate springs each consisting of four arcuate plate springs can be used to connect the first scroll to the second scroll by fixing an end of an arcuate plate spring to a first support flange of the first scroll and fixing the other end of said arcuate plate spring to a second support flange of the second scroll so that the first support flanges provided to the first scroll at equal circumferential spacing and the second support flanges provided to the second scroll at equal circumferential spacing are connected by arcuate plate springs one after the other in two rows in axial direction. When torque is transmitted from the first scroll to the second scroll so that tension stress is produced in one of the groups of arcuate plate springs belonging to a row, compression stress is produced in the other group of the arcuate plate springs belonging to the other row. Therefore, occurrence of torsion of the first scroll relative to the second scroll can be effectively prevented, and stable revolving of the revolving scroll or relative revolving motion between the both the scrolls can be achieved.

According to the invention, a scroll compressor capable of producing relative revolving motion between two scrolls engaging with each other without using conventional Oldham coupling or pin crank type mechanism.

BEST EMBODIMENT FOR IMPLEMENTING THE INVENTION

Preferred embodiments of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
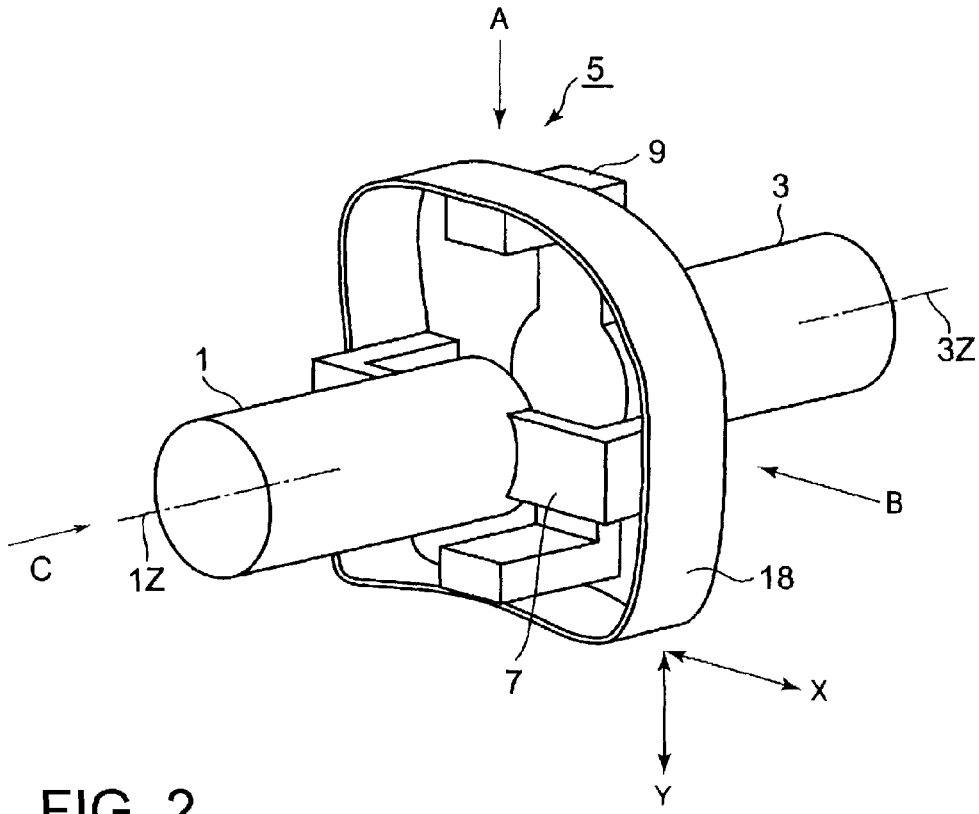
FIG. 1 is a perspective view of a shaft coupling for explaining revolving mechanism of the scroll fluid machine of the invention.
Figure 2:
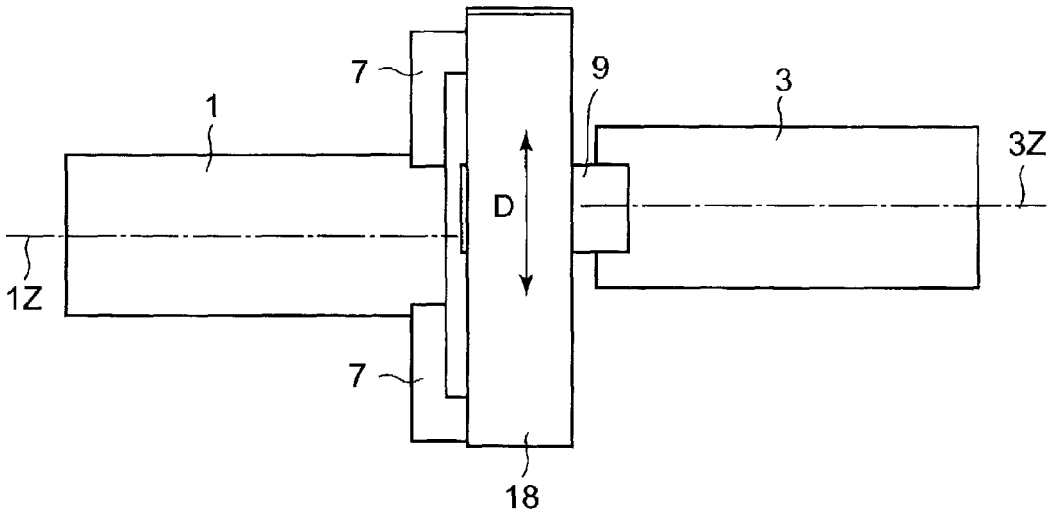
FIG. 2 is a view in the direction of arrow A in FIG. 1.
Figure 3:
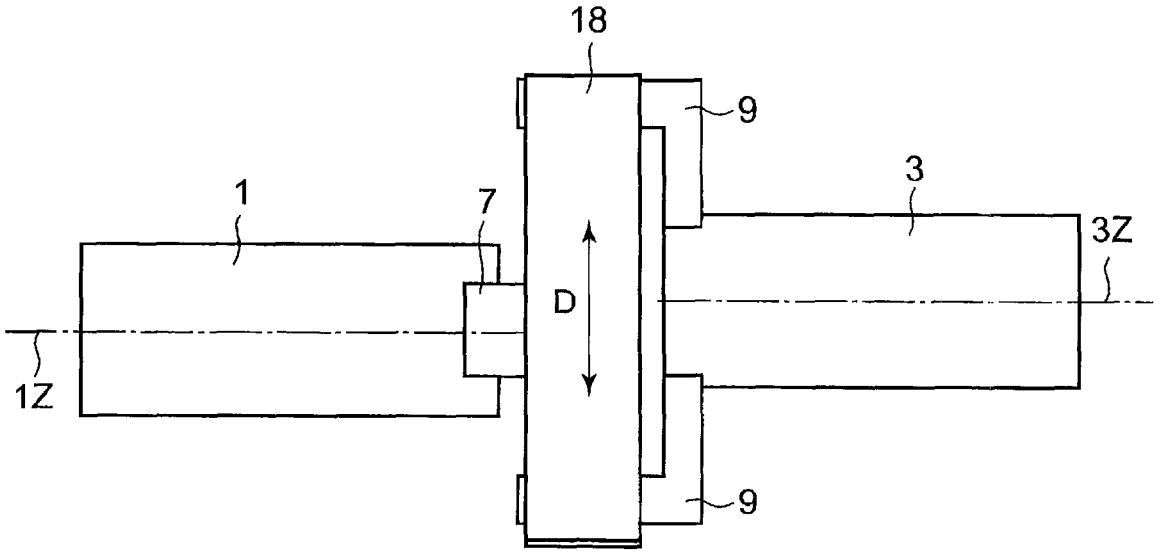
FIG. 3 is a view in the direction of arrow B in FIG. 1.
Figure 4:
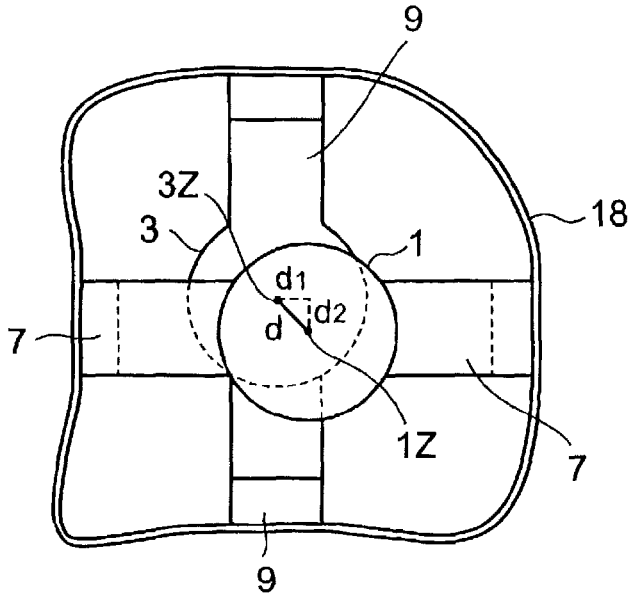
FIG. 4 is a view in the direction of arrow C in FIG. 1.
Figure 5:
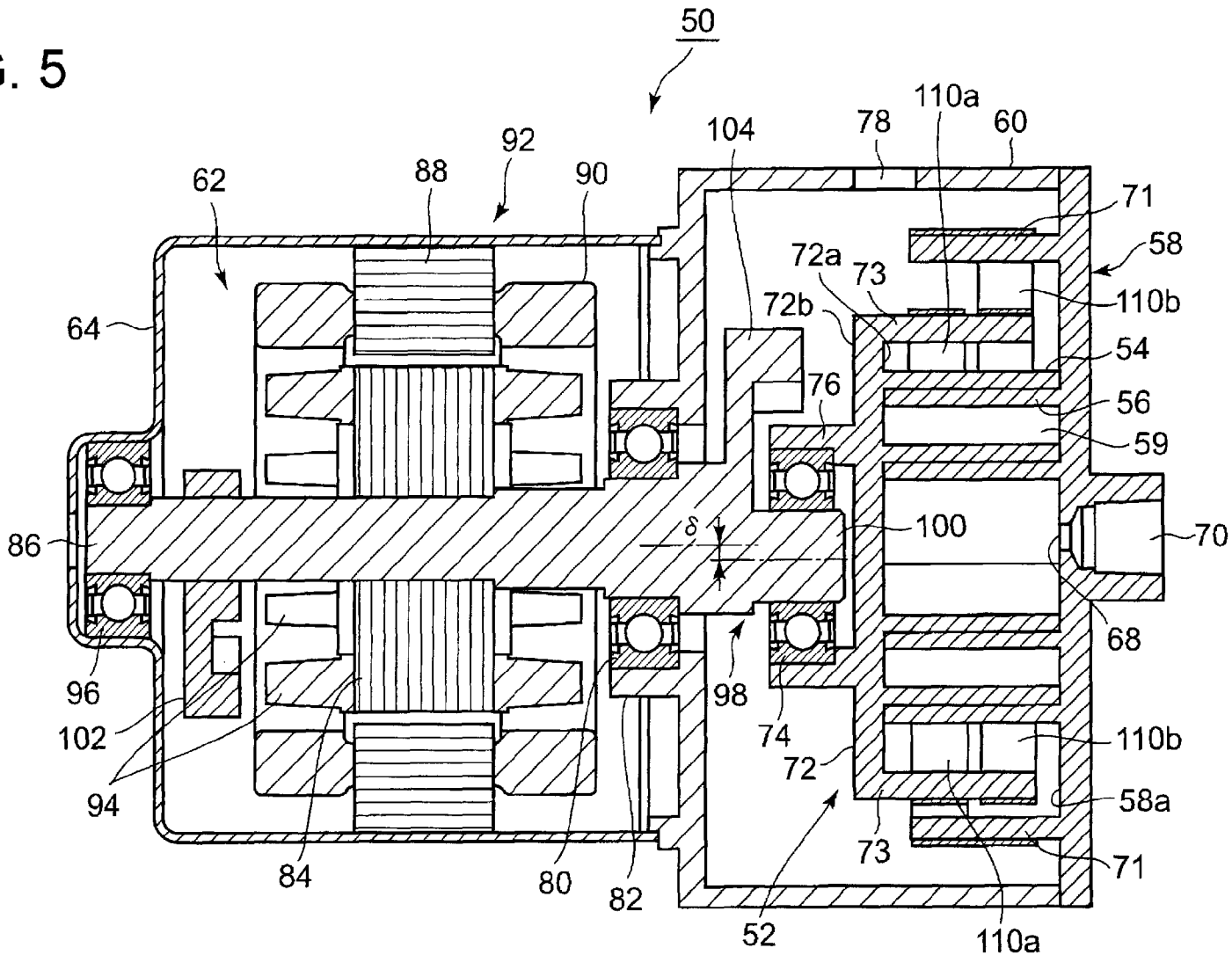
FIG. 5 is a longitudinal sectional view showing overall structure of the first embodiment of the scroll compressor.
Figure 6:
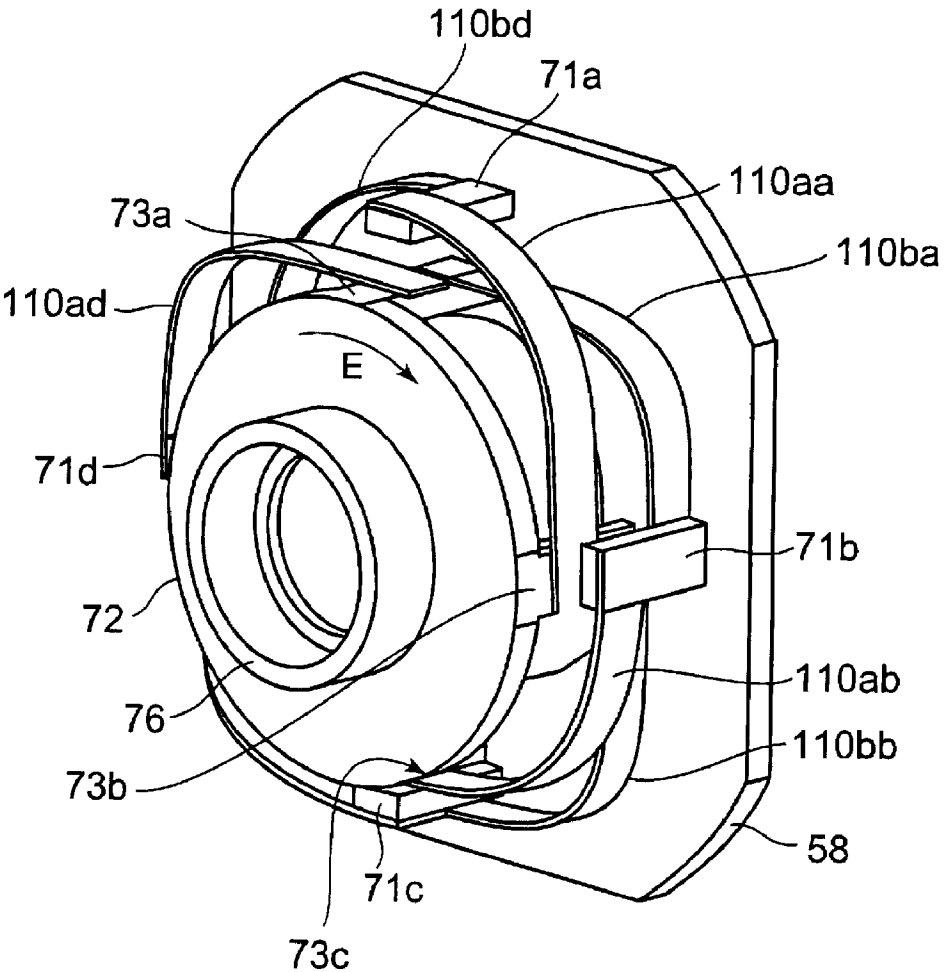
FIG. 6 is a perspective view of the revolving mechanism of scroll compressor of FIG. 5.
Figure 7:
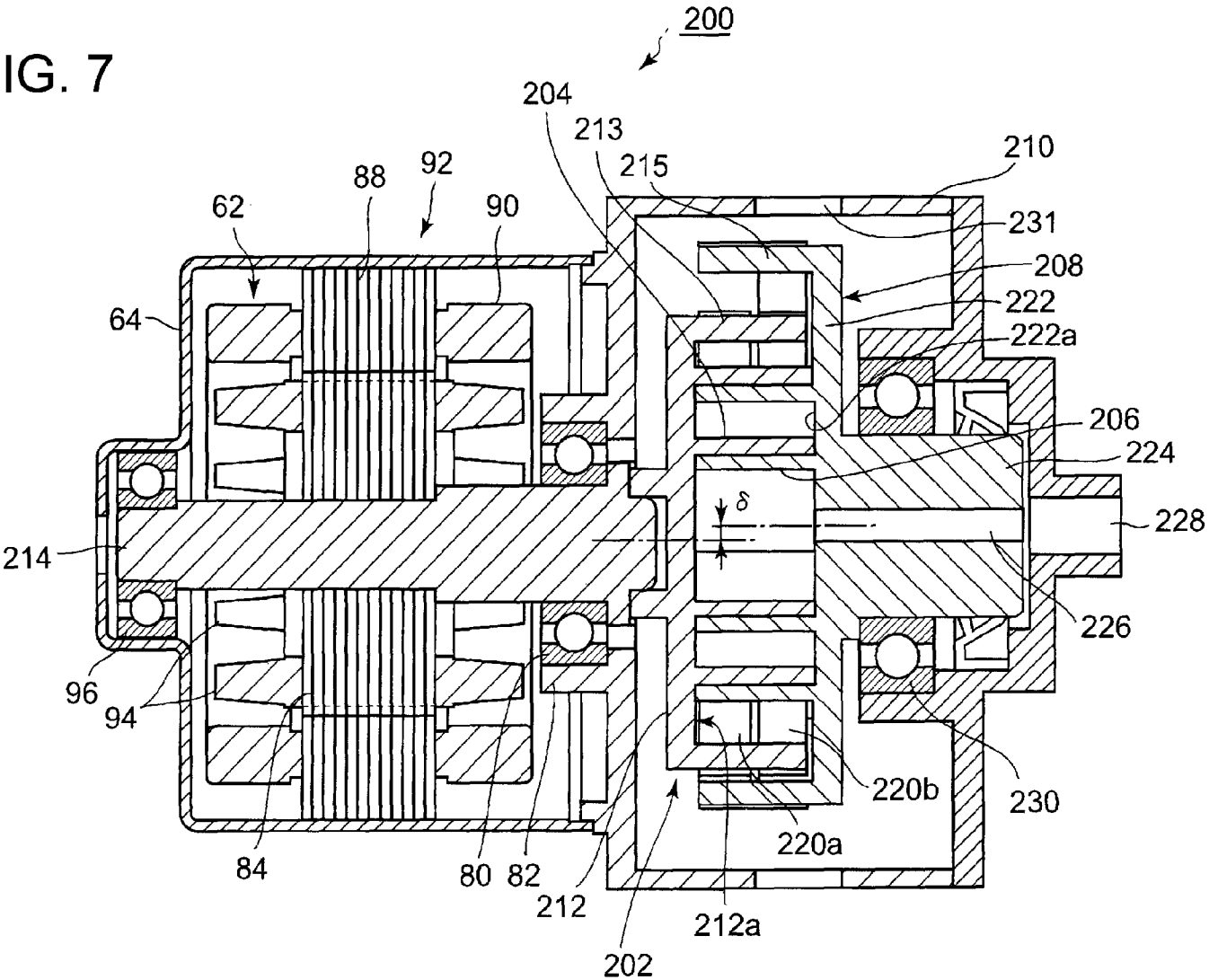
FIG. 7 is a longitudinal sectional view showing overall structure of the second embodiment of the scroll compressor.
Figure 8A:
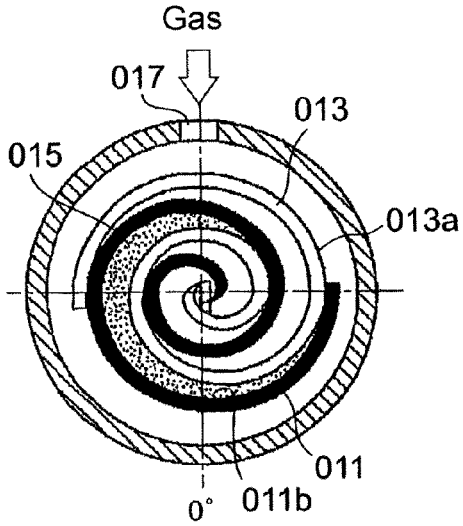
FIG. 8a (Prior Art)
FIGS. 8*a* to 8*d* are drawings for explaining compression process of a scroll compressor.
Figure 8B:
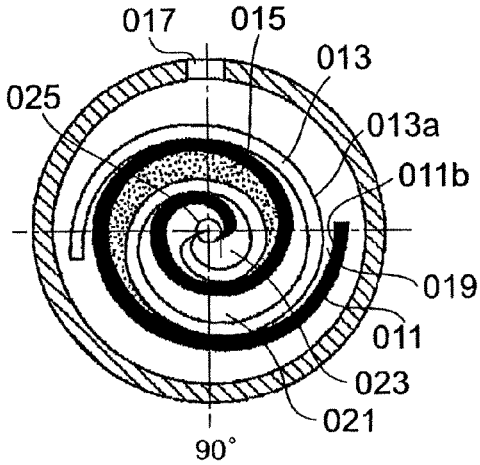
FIG. 8b (Prior Art)
Figure 8C:
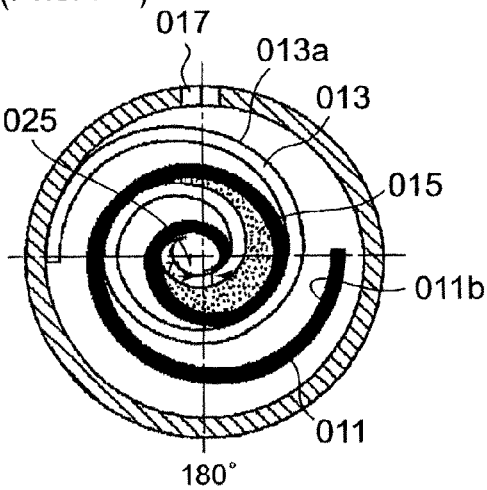
FIG. 8c (Prior Art)
Figure 8D:
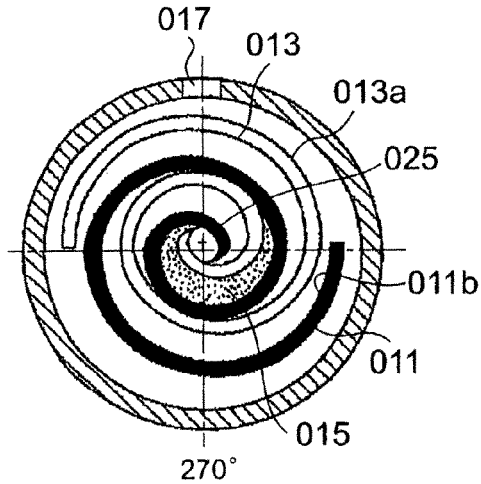
FIG. 8d (Prior Art)
Figure 9:
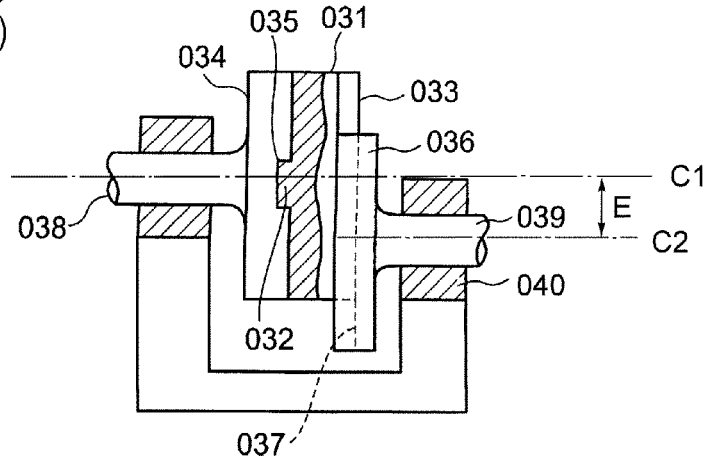
FIG. 9 (Prior Art)
FIG. 9 is a drawing for explaining Oldham coupling.
Figure 10A:
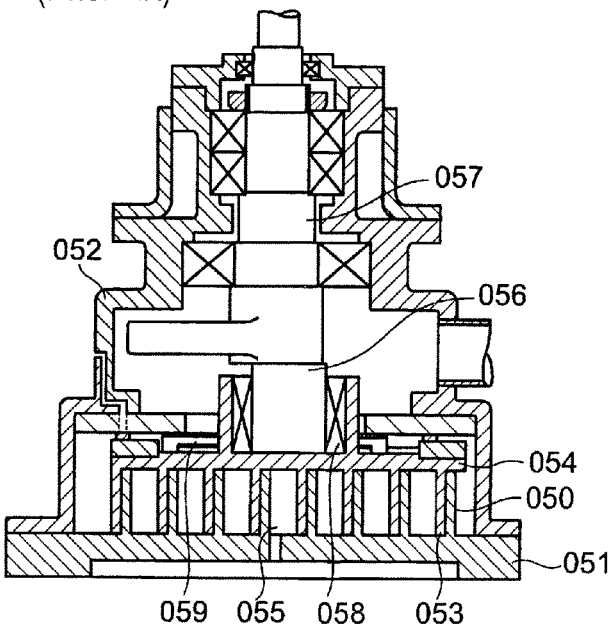
FIG. 10a (Prior Art)
FIG. 10*a* is a longitudinal sectional view of an example of conventional scroll compressor.
Figure 10B:
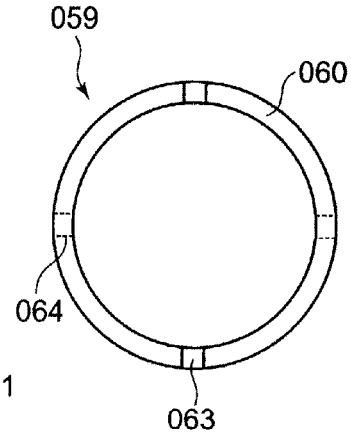
FIG. 10b (Prior Art)
FIG. 10*b* is a plan view of the Oldham ring of the compressor of FIG. 10*a*.
Figure 11A:
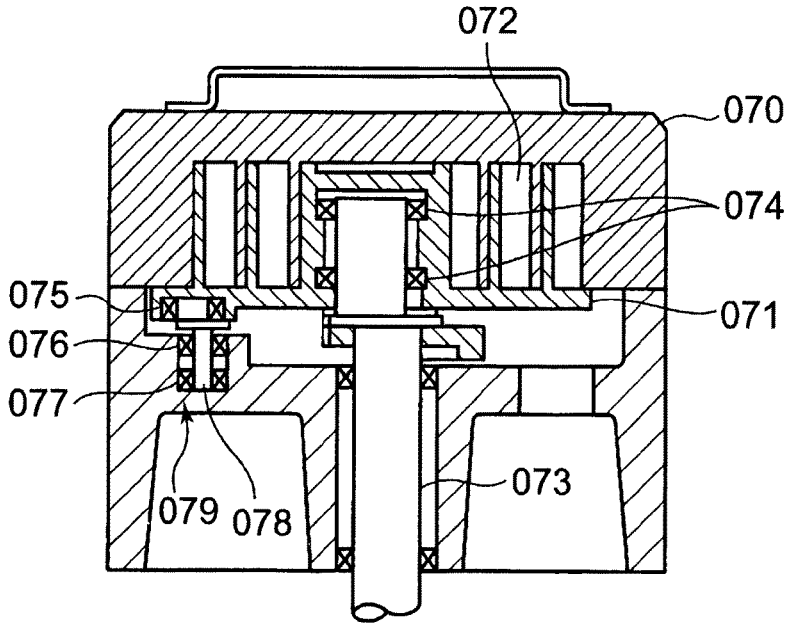
FIG. 11a (Prior Art)
FIG. 11*a* is a partial sectional view of another example of conventional scroll compressor.
Figure 11B:
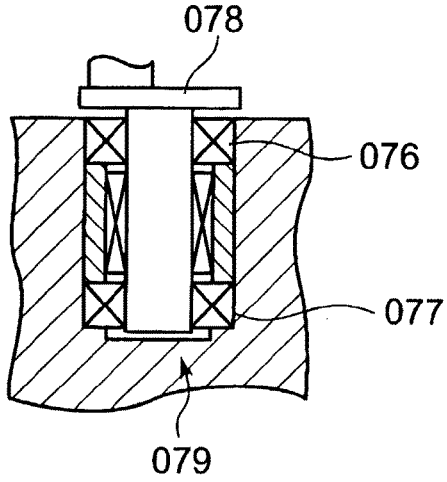
FIG. 11b (Prior Art)
FIG. 11*b* is a partial sectional view of a crank as a revolving mechanism of the compressor of FIG. 11*a*.

Drawings referred to explain the invention are as follows: FIG. 1 is a perspective view of a shaft coupling for explaining revolving mechanism of the scroll fluid machine of the invention. FIG. 2 is a view in the direction of arrow A in FIG. 1, FIG. 3 is a view in the direction of arrow B in FIG. 1, and FIG. 4 is a view in the direction of arrow C in FIG. 1. FIG. 5 is a longitudinal sectional view showing overall structure of the first embodiment of the scroll compressor. FIG. 6 is a perspective view of the revolving mechanism of scroll compressor of FIG. 5. FIG. 7 is a longitudinal sectional view showing overall structure of the second embodiment of the scroll compressor. FIGS. 8*a* to 8*d* are drawings for explaining compression process of a scroll compressor.

The principle of revolving mechanism of the scroll fluid machine of the invention will be explained with reference to FIGS. 1 to 4.

A shaft coupling 5 shown in FIGS. 1 to 4 comprises a main shaft 1 having a main shaft flange 7 at an end thereof, a follower shaft 3 having a follower shaft flange 9 at an end facing the main shaft. Each of the flanges 7 and 9 has the general shape of a letter 'U' composed of a radially extending arm part and axially extending arm parts. Radial distance of each axially extending arms from the rotation axis of each of the main and follower shafts 7. 9 is the same, the both the main and follower shafts 7, 9 are located parallel to each other such that the flanges 7 and 9 face to each other with the radially extending arm of each of the flanges 7 and 8 facing to each other.

The flanges 7 and 9 are surrounded in this state with an annular plate spring 18. The annular plate spring 18 is fixed to the axially extending arms of the flanges 7, 9 of the main and follower shafts 1, 3 by screws or by welding. A plurality of plate spring may be used.

With the shaft coupling composed as mentioned above, rotation of the main shaft 1 can be transmitted via the annular plate spring 18 to the follower shaft 3. Tension and compression stresses are produced in directions D as shown in FIGS. 2 and 3 when torque is transmitted.

When the rotation axis 1Z of the main shaft 1 coincide with the rotation axis 3Z of the follower shaft 3, the plate spring is circular. When the rotation axis 3Z is offset from the rotation axis lz of the main shaft 1 by d composed of offset d1 in the radial direction of the arm of the main shaft flange 7 and offset d2 in the radial direction of the arm of the follower shaft flange 9 as shown in FIG. 4, the annular plate spring 18 is deformed and the initial circular shape of the annular plate spring 18 collapses as shown in FIG. 4.

In this way, rotation of the main shaft 1 can be transmitted to the follower shaft 3 via the main shaft flange 7, annular plate spring 18 and follower shaft flange 9. Thus, with the shaft coupling, rotation can be transmitted between two parallel located shafts with an offset of rotation axis 1*z* and 3Z from each other without sliding parts which are necessary for a conventional Oldham coupling.

As sliding parts do not exist in this shaft coupling 5, increase of clearances between sliding parts due to abrasion does not occur, endurance of the shaft coupling is increased. Further, lubrication by lubricating oil or grease is not necessary and maintenance-free shaft coupling can be obtained. Furthermore, shaft coupling mechanism of decreased power transmission loss and decreased noise can be obtained, for there is no sliding part in the shaft coupling mechanism.

By fixing the main shaft flange 7 to a stationary scroll and the follower shaft flange 9 to a revolving (i.e., orbiting) scroll, revolving mechanism for a scroll fluid machine can be composed.

A first embodiment of the scroll fluid machine utilizing the shaft coupling mechanism mentioned above will be explained referring to FIGS. 5 and 6.

Referring to FIG. 5, a scroll compressor 50 comprises a revolving scroll 52 having a revolving scroll lap 54, a stationary scroll 58 having a stationary scroll lap 56, a scroll casing 60 fixed to the stationary scroll 58 and covering the revolving scroll 52, a motor casing 64 of a motor 62 for driving the revolving scroll 52.

A discharge port 68 and a discharge opening 70 communicating to the discharge port 68 are provided to the stationary scroll 58 at the center of the stationary scroll plate of which the inside surface is finished to a mirror surface 58*a*. The stationary scroll lap 56 erects from the mirror surface 58*a* extending spirally outward from near the periphery of the discharge port 68. A tip seal (not shown) made of self-lubricating material is received in a tip seal groove (not shown) of the stationary scroll lap 56. The stationary scroll 58 has four stationary scroll or support flanges 71 protruding from the mirror surface 58*a* at 90° circumferential spacing.

The revolving scroll 52 has an end plate 72 of nearly circular shape as shown in FIG. 6. The revolving scroll lap 54 erects from a mirror surface 72*a* of the end plate 72 extending spirally. A tip seal (not shown) made of self-lubricating material is received in a tip seal groove (not shown) of the revolving scroll lap 54.

A bearing housing 76 for receiving a ball bearing 74 is formed on a side opposite to the mirror surface 72*a* of the end plate 72 of the revolving scroll 52.

The revolving scroll 52 has four revolving scroll or support flanges 73 protruding from the mirror surface 72*a* at the periphery of the end plate 72 at 90° circumferential spacing. The stationary scroll flanges 71 are located at positions radially straightly outward from the positions of the revolving scroll flanges 73 respectively.

The scroll casing 60 has a suction port 78 at its periphery and has at its motor casing 64 side end wall a bearing housing 82 for receiving a ball bearing 80.

In the motor housing 64 is provided a rotation shaft 86 having a rotor 84, and a stator 92 consisting of an electromagnet surrounding the rotor 84 and a coil 90. A cooling fan 94 is attached to the rotation shaft 86.

The scroll casing 60 and motor casing 64 are connected by bolts not shown in the drawing.

The rotation shaft 86 is supported for rotation by a ball bearing 96 received in a bearing housing part of the motor casing 64 and the ball bearing 80 received in the bearing housing of the scroll casing 60.

The rotation shaft 86 has an offset portion 100 at a revolving scroll side end thereof offset from the rotation center of the rotation shaft 86. The revolving scroll 52 is supported on the offset portion 100 via the ball bearing 74.

A counter weight 102 is attached to an end of the rotation shaft and a counter weight 104 is attached to the other end side of the rotation shaft 86 to eliminate rotation unbalance of the rotation shaft 86 produced by the offset portion 100. The revolving scroll 52 is revolved without rotation as the rotation shaft 86 rotates, by revolving motion of the offset portion 100 of the rotation shaft 86 and rotation preventing action of the anti-rotation mechanism shown in FIG. 6.

As shown in FIG. 6, the stationary scroll flanges 71 and revolving scroll flanges 73 are connected with arcuate plate springs 110. The arcuate plate springs 110 are provided in two rows in the axial direction, namely front group arcuate plate springs 110*a* and rear group arcuate plate springs 110*b*. The front group arcuate plate springs 110*a* consists of four arcuate plate springs 110*aa*, 110*ab*, 110*ac*, and 110*ad*, each arcuate plate springs surrounding a quarter circumference of a circle. The rear group arcuate plate springs 110*b* consists similarly of four arcuate plate springs 110*ba*, 110*bb*, 110*bc*, and 110*bd*, each arcuate plate springs surrounding a quarter circumference of a circle.

The front arcuate plate spring 110*aa* connects the first stationary scroll flange 71*a* and second revolving scroll flange 73*b*, and the rear arcuate plate spring 110*ba* connects the first revolving scroll flange 73*a* and second stationary scroll flange 71*b*.

Similarly, the front arcuate plate spring 110*ab* surrounding a range of 90° connects the second stationary scroll flange 71*b* and third revolving scroll flange 73*c*, and the rear arcuate plate spring 110*bb* connects the second revolving scroll flange 73*b* and third stationary scroll flange 71*c*.

Another front arcuate plate spring 110*ac* (not appears in the drawing), another rear arcuate plate spring 110*bc* (not appears in the drawing), further another front arcuate plate spring 110*ad*, and further another rear arcuate plate spring 110*bd*, connect the revolving scroll flange 73*c*, 73*d* (not appear in the drawing), stationary scroll flange 71*c*, and 71*d*, similarly as mentioned above.

When torque is applied to the end plate 72 of the revolving scroll 52 in a direction E as shown in FIG. 6 and a rotating force exerts on the first revolving scroll flange 73*a* in the direction E, tension stress is produced in the front scroll spring 110*ad* and compression stress is produced in the rear arcuate plate spring 110*ba*, and rotation of the end plate 72 is prevented. This occurs between the four revolving scroll flanges 73*a-d* and four stationary scroll flanges 71*a-d*, the revolving scroll 52 is prevented from rotating. In this way, oil-free mechanism of revolving the revolving scroll without rotation can be obtained with simple construction.

As the arcuate plate springs 110 are provided in two rows in axial direction consisting of front arcuate plate springs 110*a* (110*aa*, 110*ab*, 110*ac*, and 110*ad*) and rear arcuate plate springs 110*b* (110*ba*, 110*bb*, 110*bc*, and 110*bd*), axial stability of the revolving scroll 52 is retained sufficiently by the rigidity of the arcuate plate springs in axial direction, and axial clearances between the tip faces of the scroll laps 54, 56 and mirror surfaces 58*a*, 72*a* of both the stationary and revolving scrolls 58, 72 can be held constant.

With the scroll compressor 50 composed as shown in FIG. 5, when the rotation shaft 86 is rotated by the motor 62, the offset portion 100 of the rotation shaft 86 is revolved about the center axis of the rotation shaft 86, and the revolving scroll 52 revolves about the axis of the rotation shaft 86 without rotation with the axial clearances between the tip faces of the scroll laps and mirror surfaces of both the stationary and revolving scrolls kept constant by the front arcuate plate springs 110*a* and rear arcuate plate springs 110*b*.

As the revolving scroll 52 can be revolved without rotation with said axial clearances maintained constant by the plate springs, sealing between the compression rooms formed by the revolving scroll lap 54 and stationary scroll lap 56 is not deteriorated, and efficient scroll compressor equipped with a simple and maintenance free revolving mechanism can be provided.

Fluid sucked from the suction port 78 is trapped in a compression room as explained referring to FIG. 8, the fluid trapped in the compression room is compressed as the rotation shaft 86 rotates and discharged from the discharge port 68 at the center of the stationary scroll 58.

According to the scroll compressor 50, the anti-rotation mechanism is composed by using front arcuate plate springs 110*a* and rear arcuate plate springs 110*b* connecting the stationary scroll flanges 71 and revolving scroll flanges 73, so the anti-rotation mechanism can be composed without sliding parts which are necessary in conventional anti-rotation mechanism such as Oldham coupling type and pin crank type. Therefore, a scroll fluid machine equipped with maintenance-free anti-rotation mechanism which does not require lubrication can be provided. Further, as the anti-rotation mechanism includes no sliding parts, noise in operation is reduced.

Next, a second embodiment of scroll fluid machine applying the anti-rotation mechanism will be explained referring to FIG. 7.

The scroll compressor 200 of the second embodiment is a so-called full-rotation type scroll compressor. The full-rotation type scroll compressor comprises a drive scroll and a driven scroll of which the rotation axis is offset from that of the drive scroll, the driven scroll is driven by the spiraling scroll lap of the drive scroll meshing with that of the driven scroll, and relative revolving motion is produced between the scroll laps of both scrolls. In FIG. 7, constituent parts the same as those of the scroll compressor 50 of FIG. 5 is denoted by the same reference numerals and explanation will be omitted.

Again referring to FIG. 1, when the main shaft 1 and follower shaft 3 are supported for rotation respectively with an eccentricity of d between the rotation axes 1Z and 3Z, rotation of the main shaft 1 is transmitted to the follower shaft 3 via the annular plate spring 18 and relative revolving motion is produced between the main and follower shafts. Therefore, revolving motion between two scroll members can be produced without fixing the stationary scroll 58 to the scroll casing 60 as is the case in FIG. 5.

Referring to FIG. 7, the scroll compressor 200 comprises a drive scroll 202 having a drive scroll lap 204, a driven scroll 208 having driven scroll lap 206, a scroll casing for covering the drive and driven scrolls 202, 208, and a motor casing 64 covers a motor 62 for driving the drive scroll 202.

The drive scroll 202 has an end plate 212, and a drive scroll lap 204 erects from a mirror surface 212*a* of the end plate 212 extending spirally outward from the center part of the mirror surface. A tip seal (not shown) made of self-lubricating material is received in a tip seal groove (not shown) of the drive scroll lap 204. The rear side opposite to the mirror surface 212*a* of the end plate 212 of the drive scroll 202 is connected to an end of a drive shaft 214.

The driven scroll 208 has an end plate 222, and a driven scroll lap 206 erects from a mirror surface 222*a* of the end plate 212 extending spirally outward from the center part of the mirror surface. A tip seal (not shown) made of self-lubricating material is received in a tip seal groove (not shown) of the driven scroll lap 206. The rear side opposite to the mirror surface 212*a* of the end plate 212 of the drive scroll 202 is connected to an end of a drive shaft 214.

The driven scroll 208 has a driven scroll shaft 224 extending from back side opposite to the mirror surface 222*a* of the end plate 222. A discharge hole 226 is drilled through the center of the driven scroll shaft 226 to open to a discharge port 228. The driven scroll shaft 224 is supported by the scroll casing 210 via a ball bearing 230 for rotation. The rotation axis of the driven scroll shaft 224 is offset from that of the drive shaft 214 by δ.

The scroll casing 210 has a suction port 231 at its periphery and a bearing housing 82 for receiving a ball bearing 80. The scroll casing 210 and motor casing 64 is connected by bolts not shown in the drawing.

The drive scroll 202 has four drive scroll or support flanges 213 protruding toward the driven scroll 208 from the mirror surface 212*a* at the periphery of the end plate 212 of the drive scroll 202 at 90° circumferential spacing. The driven scroll 208 has four driven scroll or support flanges 215 protruding toward the drive scroll 202 from the mirror surface 222*a* at the periphery of the end plate 222 of the driven scroll 222 at 90° circumferential spacing. The driven scroll flanges 215 are located at positions radially straightly outward from the drive scroll flanges 213 respectively.

Front arcuate plate springs 220*a* and rear arcuate plate springs 220*b* are provided to connect the scroll flanges 213 and scroll flanges 215 similarly as shown in FIG. 5 and FIG. 6. The front arcuate plate springs 220*a* comprises 4 quarter circular springs each covering a range of 90° to connect the first support flanges 213 to second support flanges 215, and the rear arcuate plate springs 220*b* comprises 4 quarter circular springs each covering a range of 90° to connect the first support flanges 213 to second support flanges 215, similarly as can be seen in FIG. 6.

In the scroll compressor 200 of FIG. 7 composed as mentioned above, when the drive shaft 214 is rotated by the motor the motor 62, rotation of the drive scroll 202 is transmitted to the driven scroll 208 via the mechanism composed of the front arcuate plate springs 220*a* and rear arcuate plate springs 220*b* connecting the drive scroll 202 and driven scroll 208, and relative revolving motion is produced between the drive scroll 202 and driven scroll 208 because the rotation axis of the driven scroll 208 is offset from that of the drive scroll 202 by δ and the front and rear arcuate plate springs 220*a*, 220*b* allow relative movement between the drive and driven scroll in a plane perpendicular to the rotation axes of the scrolls.

By the relative revolving motion of between the drive scroll 202 and driven scroll 208, the volume of each of compression rooms formed between the scroll laps of both scrolls reduces continuously as the scrolls rotate, so fluid sucked from the suction port 231 and trapped in a compression room is compressed in the compression room reducing in volume as the scrolls rotate and compressed fluid is discharged from the discharge port 228.

Distance between the mirror surface 212*a* of the drive scroll 202 and the mirror surface 222*a* of the driven scroll 288 can be maintained nearly constant by the front arcuate plate springs 220*a* and rear arcuate plate springs 220*b*, so sealing between the compression rooms formed by the drive scroll lap and driven scroll lap is not deteriorated, and efficient scroll compressor equipped with a simple and maintenance free revolving mechanism can be provided.

According to the scroll compressor 200, relative revolving motion is produced between the drive scroll and driven scroll while both the scrolls rotate which are connected by means of the front arcuate plate spring and rear arcuate plate spring without using a mechanism such as a crank mechanism which includes sliding parts. Therefore, a scroll compressor requiring no lubrication, maintenance-free, reduced in power for driving, and decreased in noise can be provided.

INDUSTRIAL APPLICABILITY

According to the invention, a scroll compressor capable of producing relative revolving motion between two scrolls engaging with each other without using conventional Oldham coupling or pin crank type mechanism which includes sliding parts needed to be lubricated.

The invention claimed is:

1. A scroll fluid machine comprising:

a first scroll having a first scroll lap;

a second scroll having a second scroll lap; and at least one plate spring member connecting the first and second scrolls, wherein the at least one plate spring member at least partly surrounds the first and second scroll laps with a face of the at least one plate spring member facing radially inwardly, wherein a rotation axis of the first scroll is not co-linear with a rotation axis of the second scroll to enable a relative orbiting motion between the first and second scrolls.

2. The scroll fluid machine according to claim 1, further comprising:

a casing, wherein the second scroll is a stationary scroll fixed to the casing, and wherein the first scroll is an orbiting scroll that orbits about the rotating axis of the second scroll with an orbiting radius equal to an offset between the axes of the first and second scrolls.

3. The scroll fluid machine according to claim 1, further comprising:

a casing; and a drive shaft rotatably mounted to the casing, wherein the first scroll is a drive scroll connected to the drive shaft, wherein the second scroll is a driven scroll supported for rotation by the casing with the rotation axis of the driven scroll being offset from the rotation axis of the drive scroll, and wherein the drive scroll drives the driven scroll to produce a relative orbiting motion between the drive and driven scrolls.

4. The scroll fluid machine according to claim 1, wherein:

the first scroll has a plurality of first support flanges provided along a peripheral portion of the first scroll at equal circumferential spacing, the second scroll has a plurality of second support flanges provided along a peripheral portion of the second scroll at equal circumferential spacing, the first and second support flanges are positioned at different radial distances but coincident in a radial direction respectively, and the at least one spring member connects the first support flanges to the second support flanges respectively.

5. The scroll fluid machine according to claim 4, wherein the at least one spring member is an annular plate spring.

6. The scroll fluid machine according to claim 1, wherein:

the first scroll has first, second, third, and fourth first support flanges provided along a peripheral part of the first scroll at an equal circumferential spacing, the second scroll has first, second, third, and fourth second support flanges provided along a peripheral part of the second scroll at an equal circumferential spacing, the first and second support flanges are positioned at different radial distances but coincident in a radial direction respectively, the at least one spring member comprises first, second, third, fourth, fifth, sixth, seventh, and eighth arcuate plate springs, the first, second, third, and fourth arcuate plate springs connect the first and second support flanges adjacent to each other so that the first arcuate plate spring connects the first support flange to the second support flange, the second arcuate plate springs connects the second first support flange to the third second support flange, the third arcuate plate spring connects the third first support flange to the fourth second support flange, the fourth arcuate plate spring connects the fourth first support flange to the first second support flange, the first, second, third, and fourth arcuate plate springs constitute a first row of arcuate plate springs connecting the first support flanges to the second support flanges, and the fifth, sixth, seventh, and eighth arcuate plate springs constitute a second row of arcuate plate springs provided adjacent in the axial direction to the first row of arcuate plate springs so that the fifth arcuate plate spring connects the first second support flange to the second first support flange the sixth arcuate plate spring connects the second support flange to the third first support flange the seventh arcuate plate spring connects the third second support flange to the fourth first support flange eight arcuate plate spring connects the fourth second support flange to the first support flange.

* * * * *